US006234419B1

(12) United States Patent
Hehner et al.

(10) Patent No.: US 6,234,419 B1
(45) Date of Patent: May 22, 2001

(54) WINDING-UP PROCESS AND MACHINE FOR WINDING UP PAPER OR CARDBOARD WEBS

(75) Inventors: Reinhard Hehner, Haan; Georg Müller, Neuss; Hans-Friedrich Peters, Ratingen, all of (DE)

(73) Assignee: Jagenberg Papiertechnik GmbH, Neuss (GE)

( * ) Notice: Subject to any disclaimer, the term of this patent is extended or adjusted under 35 U.S.C. 154(b) by 0 days.

(21) Appl. No.: 09/254,265

(22) PCT Filed: Aug. 28, 1997

(86) PCT No.: PCT/EP97/04680

§ 371 Date: Mar. 3, 1999

§ 102(e) Date: Mar. 3, 1999

(87) PCT Pub. No.: WO98/09901

PCT Pub. Date: Mar. 12, 1998

(30) Foreign Application Priority Data

| | | |
|---|---|---|
| Sep. 4, 1996 | (DE) | 296 15 385 U |
| Jan. 15, 1997 | (WO) | PCT/EP97/00146 |
| Jul. 19, 1997 | (DE) | 197 31 060 |

(51) Int. Cl.[7] ..... B65H 18/08

(52) U.S. Cl. ..... 242/530.4; 242/541.5; 242/541.6; 242/547

(58) Field of Search ..... 242/530, 530.4, 242/547, 541, 541.4, 541.5, 541.6, 542.4

(56) References Cited

U.S. PATENT DOCUMENTS

| | | | | |
|---|---|---|---|---|
| 3,503,567 | | 3/1970 | Casey . | |
| 3,565,746 | | 2/1971 | Stevens . | |
| 4,193,559 | | 3/1980 | Ballard . | |
| 5,165,618 | * | 11/1992 | Ruff | 242/530.4 |
| 5,240,198 | * | 8/1993 | Dorfel | 242/542.4 |
| 5,335,871 | * | 8/1994 | Fissmann et al. | 242/542.4 X |
| 5,405,099 | * | 4/1995 | Hehner et al. | 242/530 |
| 5,553,806 | * | 9/1996 | Lucas | 242/542.4 |
| 5,575,436 | * | 11/1996 | McDermott | 242/542.4 |
| 5,582,361 | * | 12/1996 | Muller et al. | 242/542.4 |
| 6,056,230 | * | 5/2000 | Peters et al. | 242/541.5 |
| 6,089,496 | * | 7/2000 | Dorfel | 242/541.5 |
| 6,105,897 | * | 8/2000 | Cramer et al. | 242/541 |

FOREIGN PATENT DOCUMENTS

| | | |
|---|---|---|
| 2 215 342 | 10/1972 | (DE) . |
| 94 20 003 U | 6/1995 | (DE) . |
| 195 05 870 A1 | 8/1996 | (DE) . |
| 0 481 029 B1 | 4/1992 | (EP) . |
| 0 629 172 B1 | 12/1994 | (EP) . |

* cited by examiner

*Primary Examiner*—William A. Rivera
(74) *Attorney, Agent, or Firm*—Herbert Dubno

(57) ABSTRACT

A process and a winding machine for winding up paper or cardboard utilizes a support roller with a compressible outer layer of at least 5 mm in thickness and a modulus of compression of less than 10 MPa and the contact pressure controlled so that the width of the nip has a minimum value which is a function of the speed with which the web is wound up.

10 Claims, 2 Drawing Sheets

WINDING-UP PROCESS AND MACHINE FOR WINDING UP PAPER OR CARDBOARD WEBS

CROSS REFERENCE TO RELATED APPLICATIONS

This application is a national stage of PCT/EP97/04680 filed. Aug. 28, 1997 and based upon German national application 296 15 385.0 of Sep. 4, 1996, PCT/EP97/00146 of Jan. 15, 1997 and German National Application 197 31 060.5 of Jul. 19, 1997 under the International Convention.

TECHNICAL FIELD

The invention relates to a process for winding paper or cardboard webs onto winding tubes and a winding machine for implementing the process.

BACKGROUND OF THE INVENTION

There are known winding machines for the production of wound rolls from paper or cardboard webs, subdivided by longitudinal cutting into individual webs, wherein winding stations are arranged on both sides of a central support roller, each winding station consisting of two support elements, the individual webs being alternately supplied to them for winding. Each winding station holds a windup roll by means of guide heads rotatably supported on the support elements, which engage laterally into the respective windup tube. Thereby the guide heads bear the entire or partial weight of the roll, in order to keep line force at the contact line with the support roller, which is decisive for the winding quality, within a desired low range.

State of the Art

EP 0 481 029 B1 describes a winding machine wherein the total roll weight is borne by the guide heads. The windup rolls are laterally pressed against the support roller with the desired line force. In order to be able to additionally influence the winding hardness, particularly in the area with reduced diameter, the guide heads are provided with rotation drives.

From EP 0 629 172 B1 a winding machine with support rollers is known, wherein the winding stations are arranged on both sides next to an apex line of the support roller. At the beginning of the winding operation, the support roller bears the entire roll weight. When the roll weight starts to be too big for the desired line force starting from a certain windup roll diameter, the guide heads take over the ever increasing load portion of the roll weight.

The DE Utility Model 296 15 385 describes a roller for a winding machine with a hollow cylinder for a support body made of a solid material, on whose shell a deformable layer is applied, which consists of a cellular plastic material with a multitude of evenly distributed pores and which has a modulus of compression κ of less than 10 MPa. It is indicated that such a roller can be advantageously used as support roller in a winding machine with support rollers, since it nearly eliminates a nip-induced expansion of the web.

OBJECTS OF THE INVENTION

It is an object of the invention to provide a process by which windup rolls of the highest quality can be produced undisturbed from paper webs, even with specific sheet weights of less than 150 g/m$^2$, at high production speeds exceeding 3000 m/min. A further object of the invention is to provide the winding machine for implementing the process of the invention.

SUMMARY OF THE INVENTION

The process of the invention for winding of paper or cardboard webs, particularly of paper webs of less than 150 g/m$^2$, onto winding tubes, has the following features:

a) The windup rolls are pressed during winding with an adjustable contact pressure against a driven support roller, which has a volume-compressible outer layer with a thickness of at least 5 mm, preferably 15 mm to 30 mm, of a cellular plastic material with a multitude of evenly distributed pores and a modulus of compression κ of less than 10 MPa, b) the web fed to the windup roller wraps around the support roller upstream of the nip between the windup roll and the support roller in a region of the roller periphery, c) depending on the construction of the outer layer the contact pressure of a windup roll against the support roller is selected so that a nip is formed which has in the direction of the roller periphery a measured width b of
   - at least 5 mm at a final production speed of more than 1000 m/min,
   - at least 15 mm at a final production speed of more than 2000 m/min,
   - at least 40 mm at a final production speed of more than 3000 m/min,
   - at least 70 mm at a final production speed of more than 4000 m/min, and d) the web exiting the nip is subjected to a traction force of at least 1 N/cm of web width, preferably 3 to 10 N/cm of web width, by means of a central drive.

The winding machine comprises:

- a longitudinal cutter for separating the web into individual webs,
- a driven support roller wrapped by the web in the area of its roller periphery,
- winding stations arranged on both sides of the support roller, each consisting of support elements movable transversely to the travel direction of the web, and for each support element a guide head, which can be introduced into the winding tube (14) and
- an additional peripheral or central drive for driving the windup roll.

The support roller consists of a support body made of a solid material, on whose shell a deformable outer layer is applied, which comes in contact with the web and which consists of a cellular plastic material with a multitude of evenly distributed pores, open in the contact surface with the web (1), and which has a compression modulus κ of less than 10 MPa, and which has a thickness of at least 5 mm, preferably 15 mm to 30 mm. Means are provided for selecting the contact pressure of a windup roll on the support roller in such a manner that a nip (7) is formed, which in the travel direction of the roller periphery has a measured width b of

- at least 5 mm at a final production speed of more than 1000 m/min,
- at least 15 mm at a final production speed of more than 2000 m/min,
- at least 40 mm at a final production speed of at least 3000 m/min, and at least 70 mm at a final production speed of at least 4000 m/min.

According to the invention, during winding the windup rolls are pressed with an adjustable contact pressure against a driven support roller partially wrapped by the web, which has an outer compressible layer made of a cellular plastic material with a multitude of evenly distributed pores and a compression module of less than 10 MPa. By means of an additional peripheral or central drive, the web exiting the nip between the support roller and the windup roll and winding on the windup roll is pulled with a traction force depending on the paper or cardboard type of at least 1 N/cm of web width. This prevents fold formation in the nip due to the difference between the web speed of the incoming web and the peripheral speed of the windup roll, which occurs as a result of the reduction of the effective radius of the support roller due to the compression of the outer layer in the nip. In order to compensate the speed difference, the web is pulled through the nip, which occurs without slippage due to the local deformation of the outer layer in the direction of the web travel.

The high production speeds are made possible by a destruction of the air boundary layer incoming on both web sides. With increasing speeds, the air boundary layer introduced into the nip during the winding of the web on the windup roll leads to problems in the winding buildup. The laminar air boundary layer is destroyed by the structured contact surface of the support roller by producing high-frequency vibration pressure peaks in the nip, which act through the web and cause turbulence in the air boundary layer on both sides of the web. The minimal width of the nip depending on the web speed insures that a sufficiently wide nip is created, wherein the boundary layer is destroyed.

The volume-compressible outer layer with a minimal thickness of 5 mm has the further advantage that it attenuates high-frequency vibrations, which stimulate the support roller from the outside, for instance vibrations triggered by windup rolls with profile variations. These vibrations are attenuated and not further transmitted to the support body, its bearing or the rest of the winding system, which results in a vibration-free winding operation.

The formation of the contact surface of the support roller at the web by means of the cellular plastic material has the further advantage that the friction coefficient between the support roller and the web remains unchanged, independently of the wear factor. In comparison to the coating with rubber, here the friction coefficient does not change because of the wear of the layer. A friction coefficient which decreases due to wear could lead to a disturbing slippage between the support roller and the web.

The dependent claims contain preferred, particularly advantageous embodiment of a winding machine according to the invention.

The drawing serves for a closer explanation of the invention with the aid of an embodiment example represented in a simplified manner.

WAYS TO IMPLEMENT THE INVENTION

Figure 1:
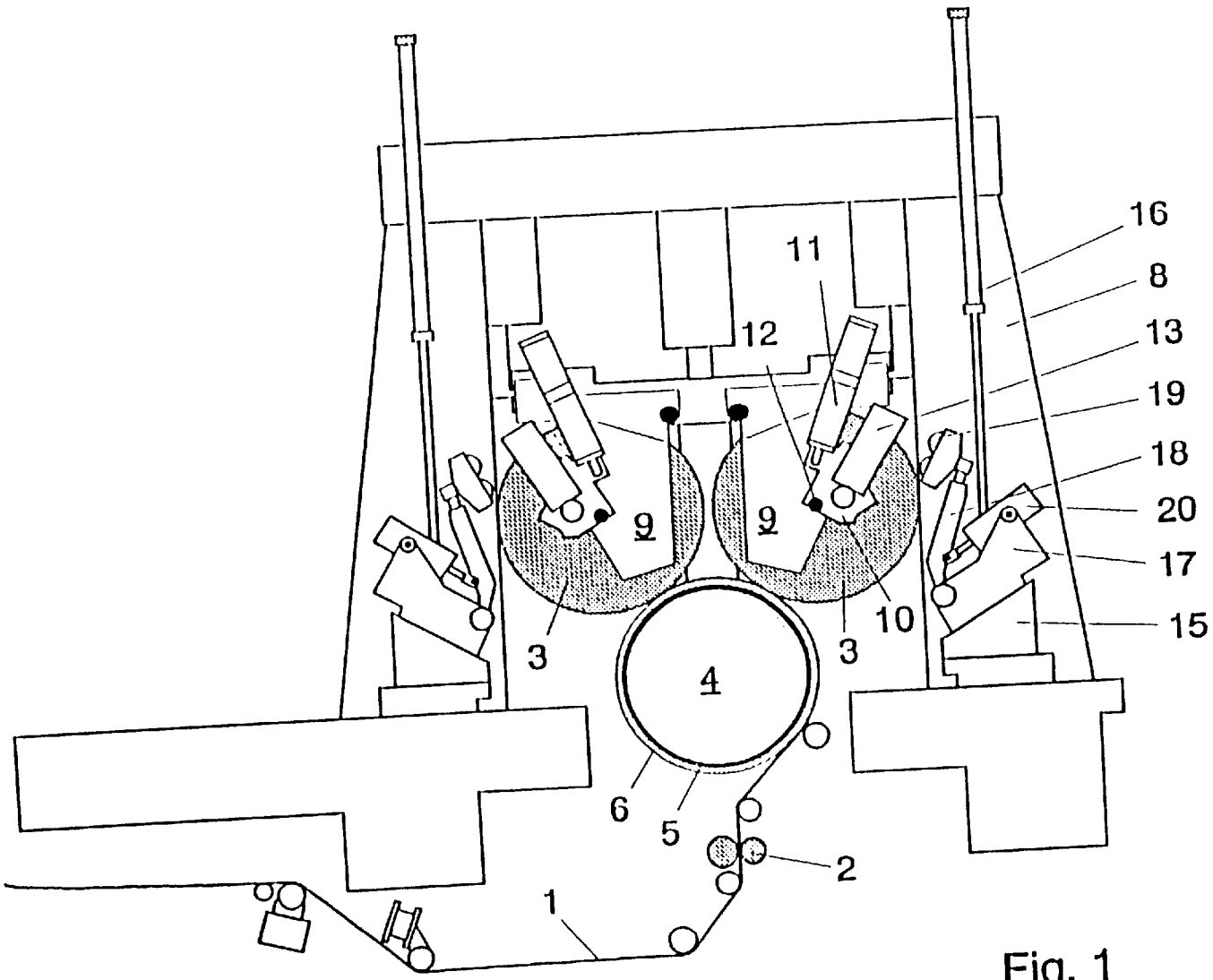
FIG. 1 shows a side view of a winding machine with support rollers according to the invention.
Figure 2:
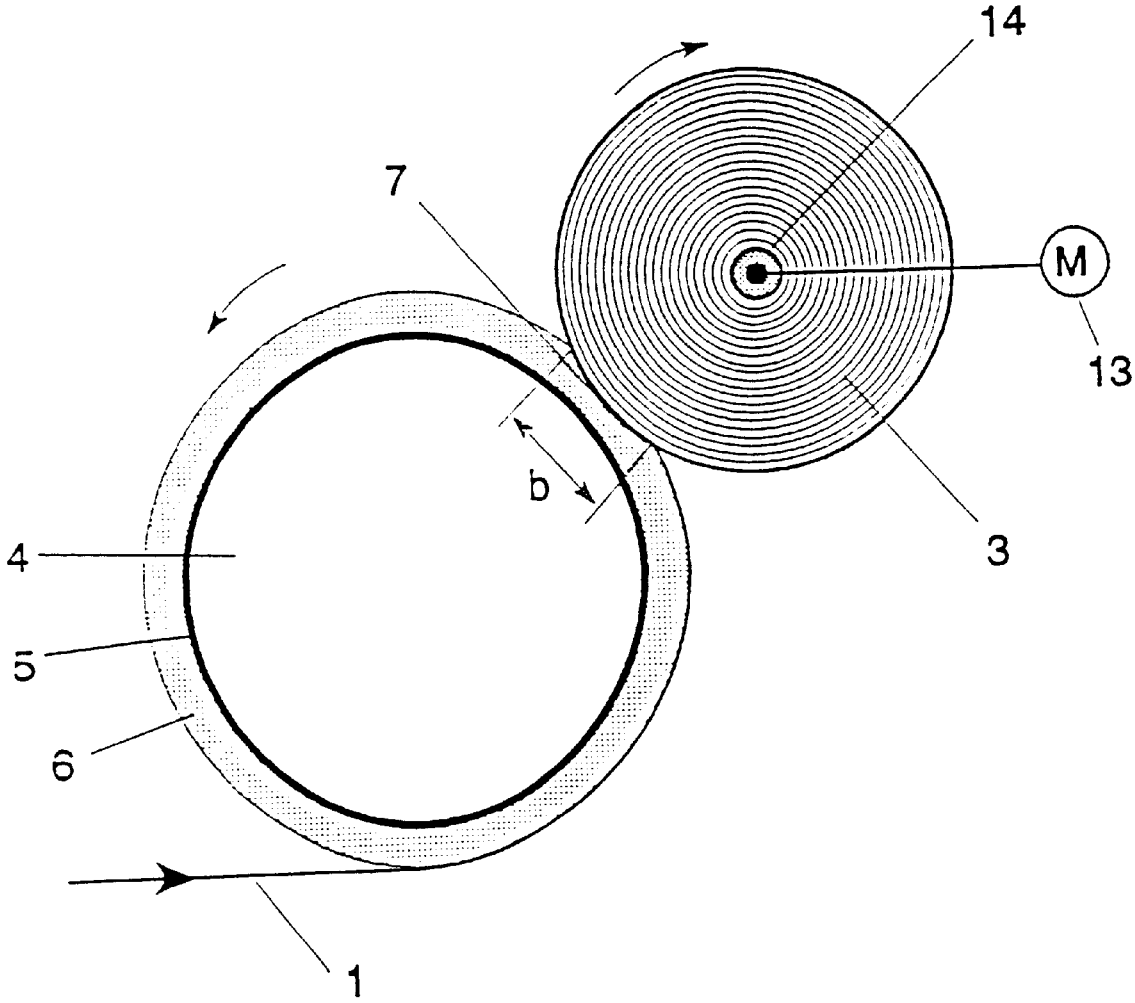
FIG. 2 shows the nip area between support roller and windup roll in a diagrammatic sketch.

In the winding machine with support roller, the paper or cardboard web 1, drawn off a supply roll not shown in the drawing, is divided into separate webs by a longitudinal cutter 2 and subsequently wound up into windup rolls 3.

The winding machine comprises a driven support roller 4 with a diameter of more than 500 mm, preferably more than 750 mm, in the example of approximately 1500 mm. The support roller 3 [sic] consists of support body 5 shaped like a hollow cylinder made of a solid material, particularly of steel, which is sufficiently stable in order not to bend under the action of the forces exerted by the windup rolls 3 supported thereon or pressed against it. The axial position of the support roller 4 corresponds to the maximal width of the paper or cardboard web 1 to be processed, which can reach up to 10 m. On both frontal sides of the support body 5 shaft journals are fastened, by means of which the support roller 4 is supported in the frame of the winding machine. A shaft journal is connected with a rotary drive, by which the support roller 4 is turned about its longitudinal axis, in order to rotate the windup roll 3 resting on or against it during the winding operation.

On the outer shell of the support body 5 of the support cylinder 4 a layer 6 made of a cellular compressible plastic material having a multitude of pores filled with gas, particularly air, which has a compression module κ of less than 10 MPa is deposited. Preferably for the layer 6 a cellular elastomer produced through foaming, particularly polyurethane, is used which has a compression module κ of 1 MPa to 5 MPa. It is important to have a great number of relatively small pores evenly distributed over the entire volume of the layer 6. The preferred pore size is smaller than 5 mm, a pore size between 0.05 mm and 1 mm has proven particularly advantageous. Preferably the pores in the layer 6 are partially open, i.e. connected to each other, and partially closed in themselves. The proportion of the open pores ranges between 30% and 70%, preferably 50%. The ratio between the open and closed pores determines the compressibility, as well as the capability of the layer to disperse the generated interior heat. The contact surface of the support roller 4 with the web 1 is formed by the outer surface of the layer 6, which therefore faces the web 1 with its open pores. Thus the contact surface towards the web 1 is provided with a structure, it has small rises and depressions. Its friction coefficient with paper or cardboard is higher than 0.25, preferably higher than 0.4, so that no slippage between the web 1 and the support roller 4 can occur. Since there is no separate outer running layer, this friction coefficient is maintained even with the wear increases at the surface.

The radially measured thickness of the layer 6 amounts to at least 5 mm, preferably 15 mm to 30 mm, so that while a windup roll 3 is pressed against it a sufficiently wide nip 7 is formed. Preferably the layer 6 consists of separate rings, which are pulled successively onto the support body and cemented to the same. Preferably annular grooves with a width between 3 mm and 8 mm, running in peripheral direction at a distance of 50 mm to 300 mm and reaching close to the support body 5 are worked from the outside into the layer 6, or rings with a width corresponding to these groove distances are pulled on at a distance from each other, which corresponds to the groove width.

On both sides of the support roller 4 winding stations are arranged, each consisting of two support elements movable parallelly to the axis of the support roller. In the present example the support elements are winding brackets 9, supported in the frame 8 of the winding machine, but it is also possible to use winding brackets supported on the ground or pivotable support arms. On each support element—in the present example on each winding bracket 9—a carriage 10 is supported so that it can move approximately radially with respect to the support roller 4, by means of a piston-cylinder unit 11. On each carriage 10 a guide head 12 is mounted, with a rotary drive 13 as a central drive. For guiding and driving the windup roll 3, the guide heads 12 can be moved into their winding tubes 14. Instead of providing the guide heads 12 with a rotary drive working as a central drive, an additional peripheral drive can also be used, e.g. a driven cylinder peripherally touching the windup roll 3, or a driven belt.

The winding stations with the windup rolls 3 are arranged so with respect to the support roller 4, that the separate webs 1 fed to the windup rolls 3, upstream of the nip 7, wrap around the support roller 4 in a peripheral area by a length of at least 50 mm. Preferably the wrapping angle of the webs 1 around the support roller 4 amounts to more than 15°, particularly more than 30°. The webs 1 are guided without slippage therefore the web speed upstream of the nip 7 correspond to the peripheral speed of the support roller 4.

In the present embodiment example the winding stations with the windup rolls 3 are arranged on both sides of the apex line of the support roller 4, against which they press during winding and which bear the roll weight entirely or partially. The individual webs 1 produced in the longitudinal cutter 2 are fed to the support roller 4 from below and are fed by it to the winding stations of the two winding lines.

It is also possible to support the winding brackets 9 on the ground, laterally next to the support roller 4, so that the guide heads 12 bear the entire roll weight. In this case the windup rolls 3 are pressed laterally with the desired contact pressure against the support roller 4. Suitably in this embodiment the web 1 is fed from above to the support roller 4 and guided by the latter to the winding stations of the two winding lines. Such a winding machine is described in the EP 0 481 029-B1.

At a distance close to the support roller 4, on each side in the frame 8 of the winding machine a crossbeam 15 is arranged, which can be raised and lowered by means of a piston-cylinder unit 16. For each winding station a carriage 17 is supported on the crossbeam 15, transversely movable with respect to the web 1. On each carriage 17 a pivot arm 18 is linked, which has at its end a pair of pressure rollers 19, which by means of a piston-cylinder unit 20 can be swung towards the periphery of a windup roll 3. At the beginning of the winding process, when the supported weight is not yet sufficient, the contact pressure in the nip 7 is increased by means of the pressure rollers 19 in order to reach the desired winding hardness. The piston-cylinder units 20 are capable of swinging the pressure rollers 19 upwards into a rest position, as shown in FIG. 1. In order to remove a finished windup roll 3 from the winding machine, the crossbeam 15 with thereto fastened pressure rollers 19 can be sufficiently raised.

The pressure rollers 19 supported to be freely rotatable have an axial length which corresponds to the minimal width of an individual web 1 to be wound up, i.e. the minimal width of windup roll 3 to be produced. Its diameter amounts to 200 mm to 400 mm. Preferably each pressure roller 19 consist also of a support body shaped like a hollow cylinder of solid material, particularly steel, on whose shell an outer layer of the same cellular plastic material as used for the outer layer 6 of support roller 4 is applied. The thickness of the compressible layer of the pressure roller 19 amounts to 5 mm to 30 mm, preferably 10 mm to 20 mm, otherwise its features and preferred design correspond the aforedescribed layer 6 of the support roller 4.

The compressible outer layer of the pressure rollers 6 has the big advantage that it can compensate the variations in the uniformity of the windup roller, which for instance result from web profile variations, this way insuring the constancy of the contact pressure. Furthermore the pressure rollers 19 designed this way can be pressed with higher pressures against a windup roll 3 than the steel rollers or roller with rubber coating, without producing undesired folds at the edges. This makes possible to produce windup rolls 3 with a bigger winding hardness in the core area around the winding tube 14.

During winding the windup rolls 3 are pressed against the support roller 4 with an adjustable contact pressure. In the embodiment of FIG. 1, the contact pressure is produced by the force of the weight of the supported windup rollers 3, whereby the desired value is set by relieving the load by means of guide heads 12, or—in case the roll weight is not yet sufficient—by an additional pressure exerted by the pressure rollers 19. If the guide heads 12 bear the entire weight, i.e. the windup rolls 3 rest only against but not on the support roller 4, the desired contact pressure is produced by pressing the guide heads 12 with a windup roll 3 in the direction of the support roller 4.

Depending on the construction of the outer layer 6 of the support roller, i.e. its design and material characteristics, the contact pressure of a windup roll 3 at the support roller 4 is set so that a nip 7 is formed, which in the direction of the roller periphery as a measured width b of

- at least 5 mm at a final production speed of more than 1000 m/min,
- at least 15 mm at a final production speed of more than 2000 m/min,
- at least 40 mm at a final production speed of more than 3000 m/min and
- at least 70 mm at a final production speed of more than 4000 m/min.

At this width the nip 7 is sufficiently big, so that the laminar air boundary layer between the web 1 and the windup roll 3 is destroyed in the nip. The destruction of the air boundary layer is caused by high-frequency vibrating pressure peaks, which are produced in the nip 7 by the structured contact surface of the support roller 4. The pressure peaks act through the web 1 and trigger destructively acting turbulence in the laminar air boundary layer on both sides of the web 1. Thereby the air between the web layer is pumped out during the passage through the nip 7.

In order to prevent crease formation in nip 7, the webs 1 coming out of the nip 7 and winding onto the windup rolls 3 are pulled by means of an additional central drive—the rotary drive 13 of the guide heads 12—and/or by means of an additional peripheral drive with a traction depending on the paper type of at least 1 N/cm of web width, preferably 3 to 10 N/cm of web width.

What is claimed is:

1. A process for winding up a paper or cardboard web comprising the steps of:

(a) supporting a windup roll against a support roller having a volume-compressible outer layer of a thickness of at least 5 mm and composed of a cellular plastic material with a multitude of evenly distributed pores and a modulus of compression κ of less than 10 MPa;

(b) driving said support roller with a speed sufficient to produce a final production speed of a wound-up web;

(c) feeding said web onto said support roller at a location upstream from a nip formed between said windup roll and said support roller and then through said nip onto said windup roller;

(d) controlling a contact pressure of said windup roll against said support roller to produce a width of said nip in a direction of rotation of said support roller and along a periphery thereof which is at least:

5 mm when said final production speed exceeds 1000 m/min, 15 mm when said final production speed exceeds 2000 m/min, 40 mm when said final production speed exceeds 3000 m/min, and 70 mm when said final production speed exceeds 4000 m/min; and (e) driving said windup roll relative to said support roller to exert a traction on the web as the web is wound onto said windup roll of at least 1 N/cm of web width.

2. The process defined in claim 1 wherein said compression modulus is between 1 MPa and 5 MPa, said thickness is 15 mm to 30 mm and said traction force is applied at 3 to 10 N/cm of web width.

3. A winding machine for winding up a paper or cardboard web, said winding machine comprising:

a longitudinal cutter along a path of said web for subdividing said web into a plurality of individual web strips;

a driven support roller having a volume-compressible outer layer of a thickness of at least 5 mm and composed of a cellular plastic material with a multitude of evenly distributed pores and a modulus of compression κ of less than 10 MPa;

plurality of winding stations arrayed along said support roller for winding said web strips on respective windup rolls, said of said stations including support elements movable transversely of a direction of travel of said webs and respective heads engageable in opposite ends of the respective windup roll and holding each windup roll against said support roller to form a nip therewith, each of said web strips being fed onto said support roller at a location upstream from the respective nip and then through the respective nip onto the respective windup roller;

means for controlling a pressure of each windup roll against said support roller to produce a width of said nip in a direction of rotation of said support roller and along a periphery thereof which is at least:

5 mm when said final production speed exceeds 1000 m/min, 15 mm when said final production speed exceeds 2000 m/min, 40 mm when said final production speed exceeds 3000 m/min, and 70 mm when said final production speed exceeds 4000 m/min; and a respective drive for at least one head at each station for driving said windup roll relative to said support roller to exert a traction on the web as the web is wound onto said windup roll of at least 1 N/cm of web width.

4. The winding machine defined in claim 3 wherein said layer consists of a cellular elastomer with a compression modulus of 1 to 5 MPa.

5. The winding machine defined in claim 4 wherein said elastomer is polyurethane.

6. The winding machine defined in claim 4 wherein said layer has a pore size between 0.05 mm and 1 mm.

7. The winding machine defined in claim 3 wherein said layer has a pore size less than 5 mm.

8. The winding machine defined in claim 3 wherein said layer has a friction coefficient relative to paper or cardboard greater than 0.25.

9. The winding machine defined in claim 8 wherein said friction coefficient is greater than 0.4.

10. The winding machine defined in claim 3 wherein said thickness is 15 mm to 30 mm.

* * * * *